United States Patent [19]

Kagan

[11] Patent Number: 4,630,795

[45] **Date of Patent: * Dec. 23, 1986**

[54] SUSPENDABLE DISPLAY RECEPTACLE

[76] Inventor: Michael Kagan, 273 Moore Park Avenue, Willowdale, Ontario, Canada

[ * ] Notice: The portion of the term of this patent subsequent to Jul. 23, 1999 has been disclaimed.

[21] Appl. No.: 126,663

[22] Filed: Mar. 3, 1980

[51] Int. Cl.[4] ..... A47H 1/10

[52] U.S. Cl. ..... 248/318; 47/67

[58] Field of Search ..... 248/318; 206/806; 220/324; 47/67, 69; D6/113, 137; 211/113, 119

[56] References Cited

U.S. PATENT DOCUMENTS

| | | | |
|---|---|---|---|
| D. 228,360 | 9/1973 | Sunshine | 47/69 X |
| D. 242,674 | 12/1976 | Sweeney | D6/113 |
| D. 250,376 | 11/1978 | Schoenbrun | 47/67 X |
| 1,183,119 | 5/1916 | Robb | 248/318 |
| 3,868,041 | 2/1975 | Knize | 220/324 |
| 3,967,578 | 7/1976 | Gallo | D6/137 X |
| 4,032,102 | 6/1977 | Wolf | 47/67 X |
| 4,079,909 | 3/1978 | Einhorn | 248/318 |

*Primary Examiner*—J. Franklin Foss

*Attorney, Agent, or Firm*—Ivor M. Hughes

[57] ABSTRACT

A display receptacle having locking means formed on its rim to hold in sockets therein the upsets of filament strands that pass in cradle fashion around a flanged groove in the locking means to reduce the tensile stress on the upsets. The strands are passed together through an aperture in a hanger ring and melded together to rest on the rim of the aperture on the ring. The strands can be equally adjusted for length from the rim of the receptacle by knotting them together at any desired position above the aperture in the ring.

6 Claims, 4 Drawing Figures

SUSPENDABLE DISPLAY RECEPTACLE

FIELD OF THE INVENTION

The present invention relates to a display receptacle intended to be suspended from a ceiling or the like, by adjustable filaments and has a locking means adjacent the rim of the receptacle for holding the filaments in tension with the receptacle without the necessity of cutting or drilling into the receptacle which often causes a crack in the receptacle walls weakening it.

In particular the present invention provides a display receptacle of clear plastic material such as acrylic, suspended by fine extruded monofilament polypropelyne strands. The strands are held to the rim of the receptacle by upsets formed in the end of each strand which mate with a locking means integrally formed with the rim of the receptacle, to cradle the strands and ensure that the tension of the suspension is borne by the monofilament strands and not solely by the upsets on their ends.

PRIOR ART AND DISADVANTAGES THEREOF

It is known to employ plastic hemisphere receptacles to hold and display plants and the like, while being suspended from a rafter or ceiling by wires or ropes attached to the rim of the receptacle. It is known in the above system of hanging displays that the ropes and or wires are difficult to adjust to give variety of distance from the ceiling and to maintain the rim of the receptacle level. The wires and ropes are attached to apertures in the rim of the receptacle which when formed or bored into the rim creates a point of weakness in the wall. The most common source of failure in the known plastic receptacles is the cracking of the wall due to the creeping of a break caused at the rim made during installation of the hangers.

Another disadvantage of known hanging devices is that the wires and ropes used therein to suspend them obstruct the view of the contents of the device being displayed therefrom. Where the known devices using ropes such as macrame, are used to suspend a display over a counter, the ropes obstruct the view of the clerk across the counter and of a patron in a commercial establishment, of the goods and clerk behind the counter. It has been recognized that in retail trades, a display device that does not obstruct the clerks view or the patrons view is needed for hanging above a counter to display wares for sale at close tempting view of the patron.

OBJECTS OF THE INVENTION

The principal object of the invention is to provide a suspended display receptacle that is made of clear plastic material and which is suspended by fine clear hangers that allow full view of the contents of the receptacle.

It is another object of the invention to provide a plurality of filament hanger fastening means on the rim of the recetacle which do not damage the wall of the receptacle during installation and which bear the weight of the whole across a broad surface rather than at a point contact to thereby protect the filament from end of strand failure.

A further object of the invention is to provide a means for securing the filament strands together in a melded joint at a common upper end with all strands of equal length and of providing a device between said common point and the ceiling suspension point to allow adjustment of height of the strands in common.

SUMMARY OF THE INVENTION

The above objects are achieved by the provision of a display receptacle which is suspended, at, at least three horizontally coplanar spaced points on its rim by supporting strands of extruded monofilament polypropylene of uniform length and connected to each other and their upper ends. Upsets are integrally provided in the material of each filament at the lower ends of each strand, and a cradle lock means is integrally formed with the rim of the receptacle at the spaced points thereon for securing the upsets thereto. The lock means has an aperture and socket for receiving the strand and the upset therein. The lock means has a bead or flange around at least one side and its base forming a space between it and the outer wall of the receptacle and providing a surface groove on the said side and base of the lock for receiving the downwardly and upwardly gathered strand which by the wrapping around the lower part or base of the lock reduces the tensile stress on the upset secured in the socket which could part the upset from the strand.

The upper ends of the filaments are melded together after each has been passed through an aperture or eye in a suspension ring to thereby allow the multi-stranded suspension to be adjusted at any common point and then held by the suspension ring at said point which is equidistant from the receptacle rim, the strands being fixed in the chosen length by knotting them together adjacent the upper side of the aperture.

IN THE DRAWINGS

With the foregoing in view and such other objects and novel features that become apparent from consideration of this disclosure the present invention consists of the inventive concept which is comprised, embodied and included in the construction method or combination of parts herein exemplified, reference being had to the accompanying drawings in which like reference numerals refer to like parts.

THE PREFERRED EMBODIMENT OF THE INVENTION

Figure 1:
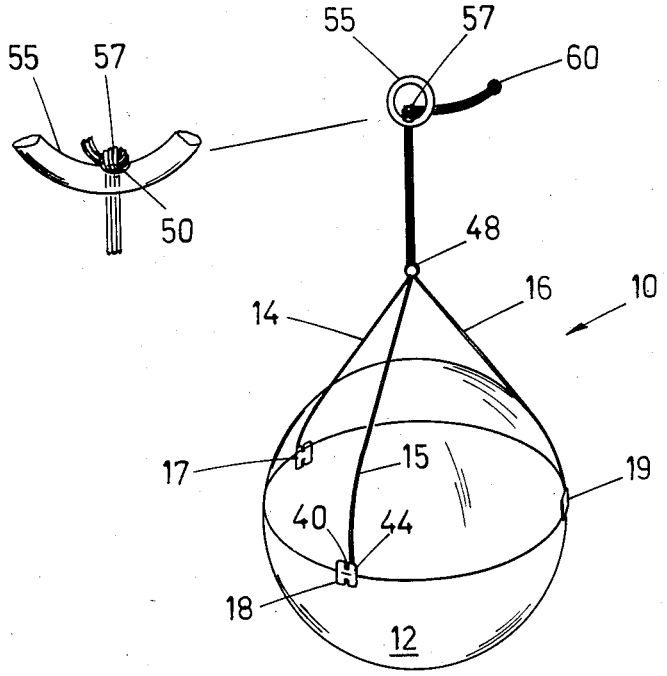
FIG. 1 is a view of the display receptacle shown suspended by three strands from a ring and shows in exploded form the means of passing the strands together through the ring and adjusting the height of the suspension strands by knotting them together above an aperture in the ring.

Numeral 10 of FIG. 1 indicates an embodiment of the invention comprising a pair of clear plastic receptacles 12,13, shown suspended by three strands of polypropylene, 14,15,16, from ring 55. Strand locking means 17,18,19 are glued to or formed integrally with the the receptacle 12 and are located on the rim to each receive the strands 14,15,16, respectively. The upper receptacle 13 can be omitted from the display except where a cover for the lower receptacle 12, is desired.

Figure 3:
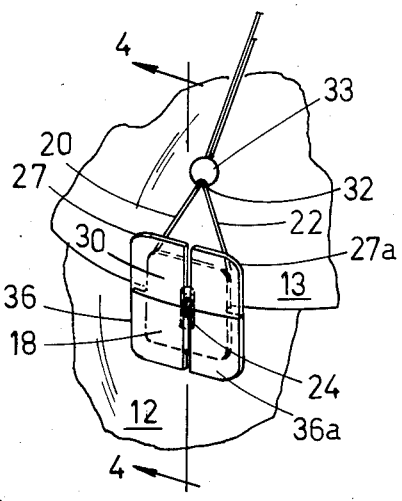
FIG. 3 is a sectional view of parts of two mating receptacles to show how pairs of lock means can positioned adjacent one another to provide a means for holding the two receptacles together by means of a pair of strands secured to the locks and gathered together by a bead.
Figure 4:
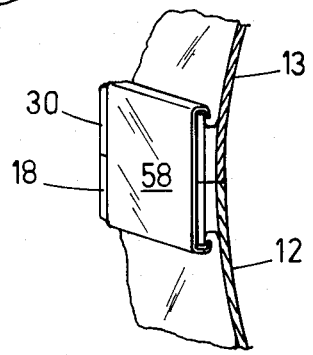
FIG. 4 is a view of the mating receptacles and their locks showing an alternative means of holding them together, namely a clip member yoked over both lock means.

Receptacle 13 is shown merely resting on receptacle 12 with the ingathering of filament strands 14,15,16, by a common bead, 48 tending to hold them together as a single covered display. Where a more secure means is required for holding the two hemispheres together is required the filament locking means of each can be mated as shown in FIGS. 3 and 4 with means for securing the locks together. In FIG. 3 a pair of filaments 20, 22 have their upsets secured at 24 by fitting into a socket shown in FIG. 2 as numeral 40, of the lower lock means 18. The filaments are then passed around the outer beaded and flanged sides of the lower lock 18, one strand 20 to one side 36 and the other strand 22 to the other side **36*a*. Strand 20 is then passed into the space between the bead of one side of lock 30 on the upper receptacle 13 enumerated in the FIG. 3 as 27, and strand 22 is passed into the space 27*a* on the other side of the upper lock means 30. The strands can then be gathered together by a common bead 33 having an apeture therethrough 32 into which both strands 20,22 can be fitted to allow bead 33 to travel freely along them to tighten the strands in the lock 30 or to allow the top receptacle 13 to be freed from 12**.

The alternative means of securing a pair of mating locks 18,30 is shown in FIG. 4 where a simple clip means 58 with flanged edges is fitted over the locks 18,30 with the flanges of the clip 58 gripping the flanged beads of their sides to thereby provide a yoke means for the pair of locks of the strand securing means of the receptacles.

Figure 2:
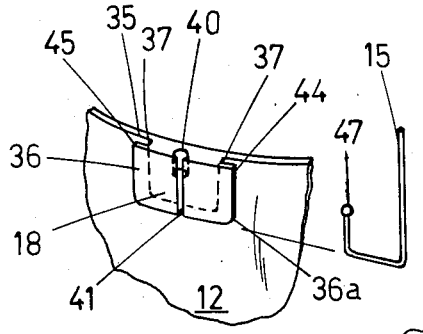
FIG. 2 is an enlarged view of the strand lock means as attached to a section of the receptacle proximate its rim, and shows a strand exploded from the socket and bead to show the manner of wrapping it.

An enlarged view of the locking cradle 18 of the lower receptacle 12 is shown in FIG. 2 with the strand 15 shown exploded from its hold position in the socket 40 and the space formed by bead flange **36*a*. The lock cradle 18 comprises a tabulate body secured to the outer wall of the receptacle 12 in the vicinity of the rim 35. A flanged bead portion 36,36*a* projects curvilinearly around the tabulate body 18, sides and base. Lock 18 is spaced out around its edges from the receptacle 12 to create slots 37 therebetween. A socket 40 is provided in the upper side of the cradle 18 to receive the upset 47 formed on the end of the filament 15. A slotted groove 41 is formed downwardly from the socket 40 and in the mid section of the tabulate body 18 and communicates with both the socket 40 and the slots 37 which are created by the beads 36,36*a* of the lock 18, and is adapted to receive the end portion of the strand 15 adjacent the upset 47 when the upset is seated secure in socket 40**.

The bead **36,36*a*, is enlarged inwardly at upper corners 44,45 of the tabulate body of cradle lock means 18, to reduce the space between the bead and the receptacle outer wall to require flexure of the bead at those locations by the pressure of the filament strand 15 when it is pushed into the space to thereby allow the strand to seat in the space during use in suspension of the receptacle. The thickened bead at 44,45 assists in maintaining the strand in its position around the body 18 thereby maintaining even tensile pressure on the strand as it is cradled in the slots 37 formed by the beads 36,36*a***.

MODE OF OPERATION

In suspending the display receptacle, the upsets of each of three strands 14,15,16 can be first set into the sockets of their three respective cradle locks 17,18,19 and the strands pulled down between the beads on the sides of the cradle and the wall of the receptacle and forced into slots 44 and then the strands are gathered up together and threaded through an aperture in bead 48 to become thereafter a common multi-strand suspender which is then threaded through aperture 50 in a holding ring 55 after which the ends are melded together to create a unit having equal distance between the rim of the receptacle. The melded end is numbered 60.

The aperture or eye 50 in ring 55 serves to allow the multi-strand suspension means to be adjustable to locate the receptacle thereto at a specific required level. This is done by knotting the strands together at any desired location 57 above the ring where it binds to be held by the ring.

Where heavy loads are to be used in the receptacle, such as earth for a terrarium, pairs of strands as shown in FIG. 3 are used and the socket 40 is enlarged to seat the two upsets.

Where it is desired to have the upper receptacle 13 removeably suspendable above receptacle 12 while the contents of 12 are being examined removed or replaced for example, a ring means and filament strand (not shown) could be attached to the top of the receptacle 13 for temporary lifting of the receptacle. The filament could be attached to ring 55.

Other uses and variations of the invention herein disclosed can be devised without departing from the scope of the appended claims.

Where it is desired by the user to be able to display and arrange a plant having cascading foliage without having the hangers obstructing his freedom to work with the receptacle or where it is desired to package and transport the receptacles in nesting mode and the hangers in separate mode the hangers can be gathered together on the ring prior to their installation on the locks. The strands are each made of equal length and the upsets formed on their ends. The three free ends are first passed through the gathering bead (when used) and then passed together through the ring aperture. The three (or more) free ends are melded together to provide a hanger each strand of which is equal in length. The ring will prevent the strands from pulling through by holding the meld against the rim. After the user has filled the receptacle the upsets are fitted to their cradle locks and the combination of receptacle and hangers hung to a suitable hook from the rafter. With the melded ends held on the rim of the ring the user can adjust the distance of the receptacle from the hooked ring by pulling up the strands through the aperture in the ring and tying them together in a knot to seat on the ring rim at the desired height.

What I claim is:

1. A suspendable display unit comprising in combination; a display receptacle, in situ, suspended at, at least three horizontally co-planar spaced points, a plurality of supporting strands of uniform length connected to each others' upper ends, upsets integral with the material of said strands at the lower ends of said strands, means on said receptacle at said spaced points for securing said upsets thereto so as to reduce tensile stress tending to part said upsets from said strands, said means for securing said upsets each comprise essentially a tabulate body having a central portion secured against said receptacle at or in the vicinity of the rim of said receptacle, a bead projecting from and extending curvilinearly around at, at least one side and a base portion of said body and being also spaced from said receptacle, said securing means also including a socket for said upset, the end portion of said strand adjacent said upset being receivable against the slight outward flexure of at least the upper end of said bead under lateral pressure upon said end portion of said strand, into the space between said bead and said receptacle, and means on said strands for gathering said strands into a single multi-stranded suspension at any desired common point equidistant from said receptacle and securing said strands at said common point, and means for adjusting the effective length of said suspension and retaining it at said effective length from a location above said unit.

2. The invention according to claim 1 in which at least said upper ends of said bead is thickened so as to reduce the space between said upper end and said receptacle to facilitate the clipping action of said strand into an elongated groove formed between said bead and said receptacle.

3. The invention according to claim 2 which includes a superposed receptacle substantially perimetrically engageable with the first receptacle and a set of substantially U-shaped yokes engageable with open sided spring-slots extending around the opposite sides of said means for securing in and around a continuation of each base portion, said yokes being clippable into similar means for securing upon said superposed receptacle.

4. The invention as in claim 3 in which said socket embodies an open-sided stop for said strand extending centrally of said means for securing said stop being co-terminous with said space between said bead and receptacle.

5. The invention as in claim 1 in which means for adjusting the effective length of said suspension embodies a ring having an open-ended aperture extending diametrically therethrough, through which aperture said suspension may pass and be knotted so that the knot bears downwardly against the rim of said aperture upon the inner surface of said ring when said ring is suspended from a hook or the like.

6. The invention as in claim 1 in which said gathering means embody as open aperture element through which said strands may pass in close proximity.

* * * * *